US005494251A

United States Patent [19]

Katz

[11] Patent Number: 5,494,251

[45] Date of Patent: Feb. 27, 1996

[54] ARTIST'S EASEL

[76] Inventor: Martin M. Katz, 10100 Peach Pkwy. #M105, Skokie, Ill. 60076

[21] Appl. No.: 187,761

[22] Filed: Jan. 27, 1994

[51] Int. Cl.[6] ..... A47B 97/04

[52] U.S. Cl. ..... 248/449; 248/448; 248/456

[58] Field of Search ..... 248/448, 449, 248/454, 455, 456, 459

[56] References Cited

U.S. PATENT DOCUMENTS

| | | | |
|---|---|---|---|
| 396,362 | 1/1889 | Marks . | |
| 498,578 | 5/1893 | Schmirk . | |
| 518,544 | 4/1894 | Faint . | |
| 2,083,839 | 6/1937 | Grieve | 248/448 |
| 3,006,107 | 10/1961 | Tolegian | 248/449 |
| 3,114,215 | 12/1963 | Turkin | 45/129 |
| 3,122,858 | 3/1963 | Kadin | 45/129 |
| 3,809,354 | 5/1974 | Phifer | 248/449 |
| 4,042,203 | 8/1977 | Warkentin | 248/449 |
| 4,925,147 | 5/1990 | Potter | 248/463 |
| 5,004,204 | 4/1991 | Cook | 248/449 |

*Primary Examiner*—Karen J. Chotkowski
*Assistant Examiner*—Gwendolyn Wrenn
*Attorney, Agent, or Firm*—Silverman, Cass & Singer, Ltd.

[57] ABSTRACT

An artist's easel for supporting a canvas or other workpiece including a carriage having two upright housing masts which each have a longitudinal axis substantially parallel to the other, a slidable outer frame extensibly engaged with the housing masts including a bottom workpiece support for receiving a bottom portion of the workpiece, the outer frame being substantially coplanar with and adapted to slide in a range of motion parallel to the longitudinal axes of the housing masts, a slidable inner frame extensibly engaged with and substantially coplanar to the outer frame and adapted to slide in a range of motion parallel to the range of motion of the outer frame, the inner frame including an adjustable top workpiece support for receiving a top portion of the workpiece, the top workpiece support being slidably mounted to the inner frame and adapted to slide colinear with the range of motion of the inner frame.

15 Claims, 7 Drawing Sheets

ARTIST' S EASEL

BACKGROUND OF THE INVENTION

1. Field of the Invention

This invention relates generally to artist's easels, and more particularly to an easel including slidable inner and outer frames extensibly engaged with two upright masts of an easel carriage where a wide range of canvas sizes may be accommodated and the placement or repositioning of a canvas at an elevation ranging from floor level to a level near the inner frame's full extension point may readily be achieved by selectively positioning the extensible inner and outer frames with respect to each other and to the upright masts and by adjusting the position of canvas supports on the inner and outer frames.

2. Description of the Related Art

Artist's easels support a canvas or other workpiece to facilitate the creation of paintings. To hold a particular canvas in place, easels generally incorporate top and bottom canvas supports on a frame or base.

To provide mobility and accommodate a range of canvas sizes, a wheeled easel may be provided having a barrel which telescopes or extends from a fixed stem supported by a wheeled base. An upper support is fixed non-adjustably to the telescoping barrel and a lower support slides along the stationary mast and is fixed in position by a clamp. An example of such an easel is illustrated in U.S. Pat. No. 4,925,147. In that device, however, the highest elevation to which the canvas may be positioned is limited by the lower support which has a range of movement extending only to the end of the stem.

That easel also does not incorporate an adjustable top canvas support, much less an adjustable top support having a range of movement essentially extending from floor level to the end of the telescoping barrel. That easel further does not incorporate a second extensible frame to accommodate and permit ready repositioning of canvas sizes ranging from miniatures to murals at a full range of elevations.

Another type of easel provides a single sliding frame within a frame piece where a canvas is set on a box secured to the sliding frame. The canvas is fastened in position on the sliding frame by a crosspiece slidably mounted to the sliding frame. An example of such a device is illustrated in U.S. Pat. No. 396,362. In that device, however, the upper crosspiece is not mounted to an inner extensible frame engaged within an outer extensible frame. Consequently, the upper crosspiece is not capable of extending beyond the single sliding frame's highest elevation. The maximum canvas size which can be accommodated by that particular easel is thereby limited by the length of the sliding frame. Additionally, the workpiece mounts to the box secured to the sliding frame. Consequently, the elevation of the bottom edge of the workpiece cannot extend higher than the stationary frame.

It therefore is desirable to provide an easel which has two extensible slidable frames, where both may be used in tandem or one may be used independent of the other, to mount a wide variety of canvas sizes ranging from miniatures to large murals.

To allow use by persons of different stature and to permit a particular section of a canvas being painted to be positioned at a desired level, it also is desirable to provide an easel which permits positioning the canvas at an elevation ranging from a low point near floor level to a high point on the inner frame when the extensible frames are at their farthest extension.

It is further desirable for one person to be able to adjust the elevation of the canvas with a minimal amount of effort, especially for large canvasses, and without having to adjust clamps.

In addition, it is desirable that the easel can be tilted either forward to circumvent glare or backward for placement of massive canvasses, that the easel have a mobile carriage, and that the easel can accommodate large canvasses without unduly increasing the overall size and weight of the easel.

SUMMARY OF THE INVENTION

The invention is characterized by an artist's easel for supporting a canvas or other workpiece which includes a carriage, a slidable outer frame and a slidable inner frame. The carriage includes two upright housing masts which each have a longitudinal axis substantially parallel to the other. The outer frame is extensibly engaged with the housing masts, is substantially coplanar with the masts and includes a bottom workpiece support to receive a bottom portion of the workpiece. To accommodate different size workpieces and vary the elevation of a workpiece mounted to the bottom support, the outer frame is adapted to slide in a range of motion parallel to the longitudinal axes of said housing masts. The inner frame is extensibly engaged with and substantially coplanar to the outer frame and includes an adjustable top workpiece support to secure a top portion of the workpiece. To allow movement of the inner frame in conjunction with or independent of the outer frame, the inner frame slides in a range of motion parallel to the range of motion of the outer frame. A removable auxiliary workpiece support may be provided to mount various size workpieces solely to the inner frame.

DESCRIPTION OF THE PREFERRED EMBODIMENT

Figure 1:
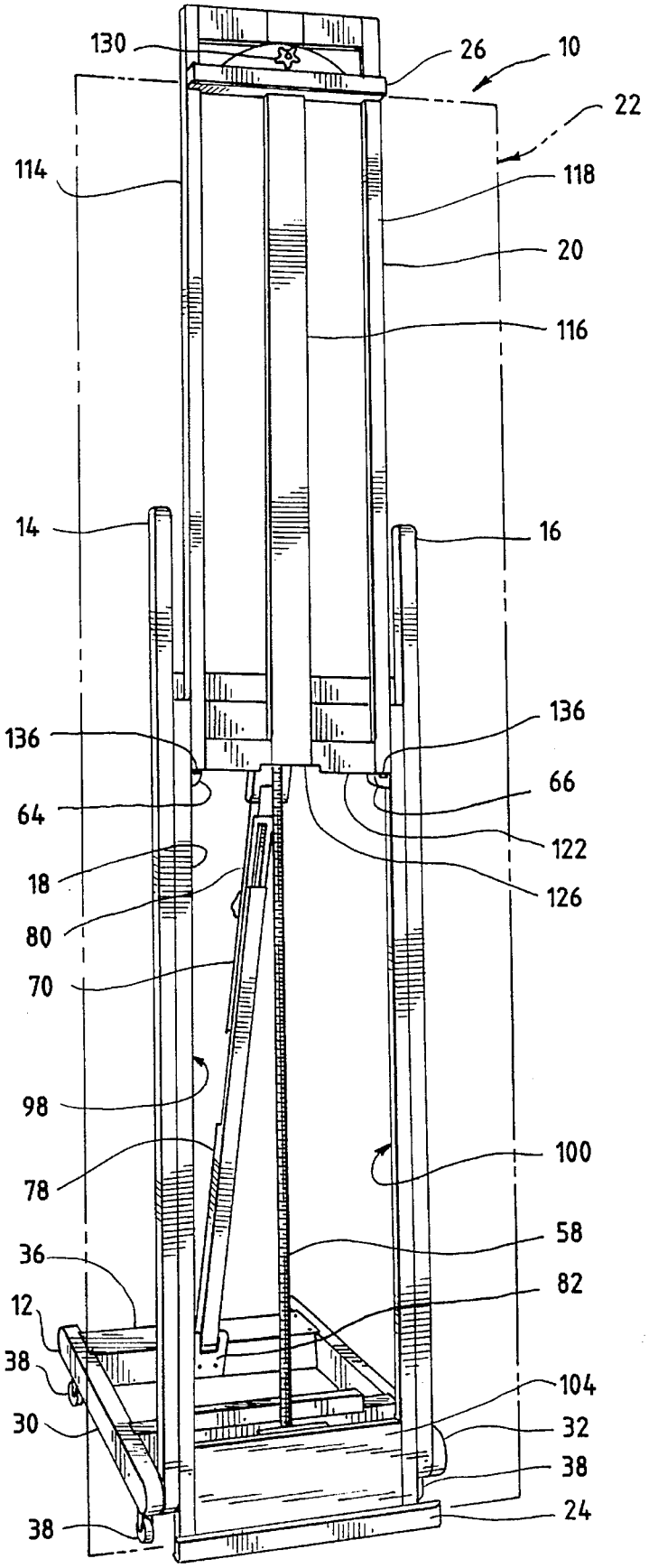
FIG. 1 is a front perspective view of the easel of the invention illustrating the outer frame in a retracted position and the inner frame in an extended position with a large canvas shown in phantom outline seated therebetween.

Referring to FIG. 1, the artist's easel of the invention generally is designated by numeral 10. The easel 10 includes a carriage 12, a pair of housing masts 14 and 16, an outer frame 18 and an inner frame 20. Most parts of the easel 10, except for the fasteners, fixtures and the like preferably are constructed of oak, although any other suitable material having sufficient strength may be used.

Figure 4:
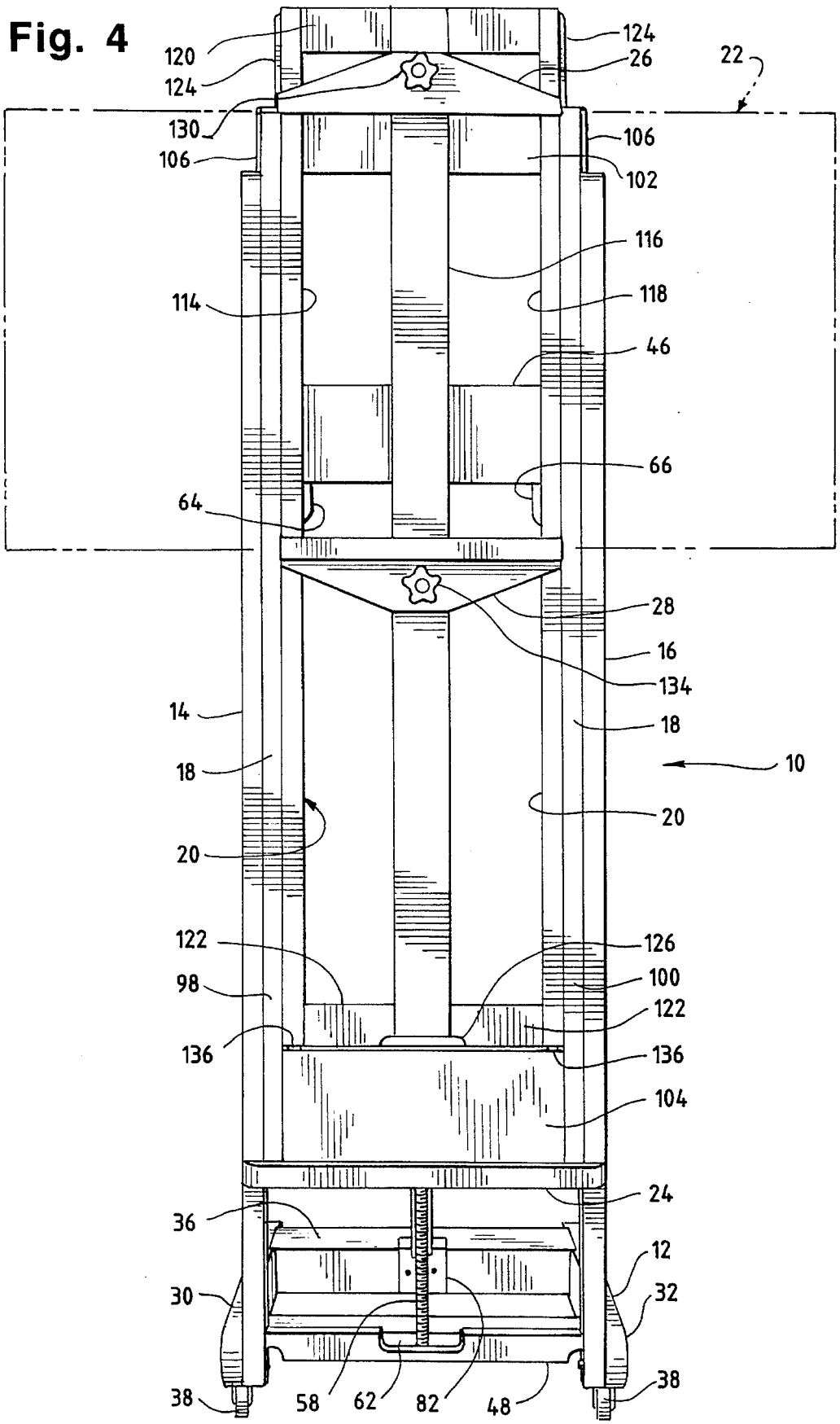
FIG. 4 is a front elevational view of the easel with the outer frame partially extended and the inner frame having the top canvas support and the auxiliary canvas support positioned thereon with a canvas seated between the canvas supports as illustrated in phantom outline.

Briefly, in operation, a canvas or workpiece 22 is seated between a bottom canvas support 24 on the outer frame 18 and a top canvas support 26 on the inner frame 20. To secure and reposition the canvas 22 independent of the outer frame 18, an auxiliary canvas support 28 may be mounted on the inner frame 20 as FIG. 4 illustrates. Different size canvasses 22 are accommodated by varying the position of the outer frame 18 and the inner frame 20 which are extensible with respect to the housing masts 14 and 16. Different size canvasses 22 also may be accommodated by adjusting the position of the top canvas support 26 with respect to the bottom canvas support 24 or the auxiliary canvas support 28. The canvas 22 also can be set at a particular elevation by extending or retracting either the outer frame 18 where the canvas 22 is seated on the bottom support 24 or the inner frame 20 where the canvas 22 is seated on the auxiliary support 28.

Figure 2:
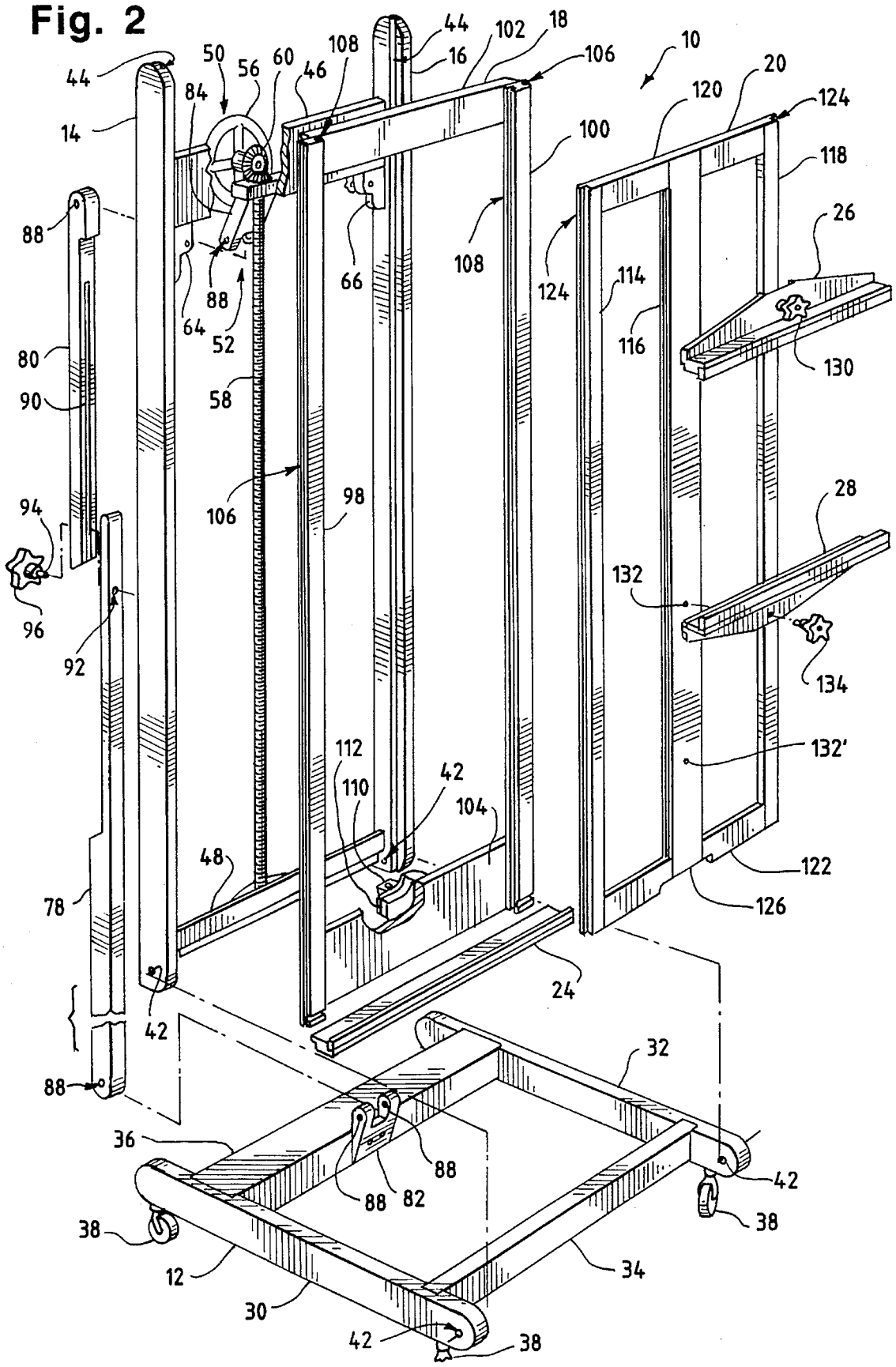
FIG. 2 is an exploded perspective view of the easel including carriage, canvas supports, inner frame, outer frame, housing masts, canvas lifting assembly and telescoping angle support.
Figure 5:
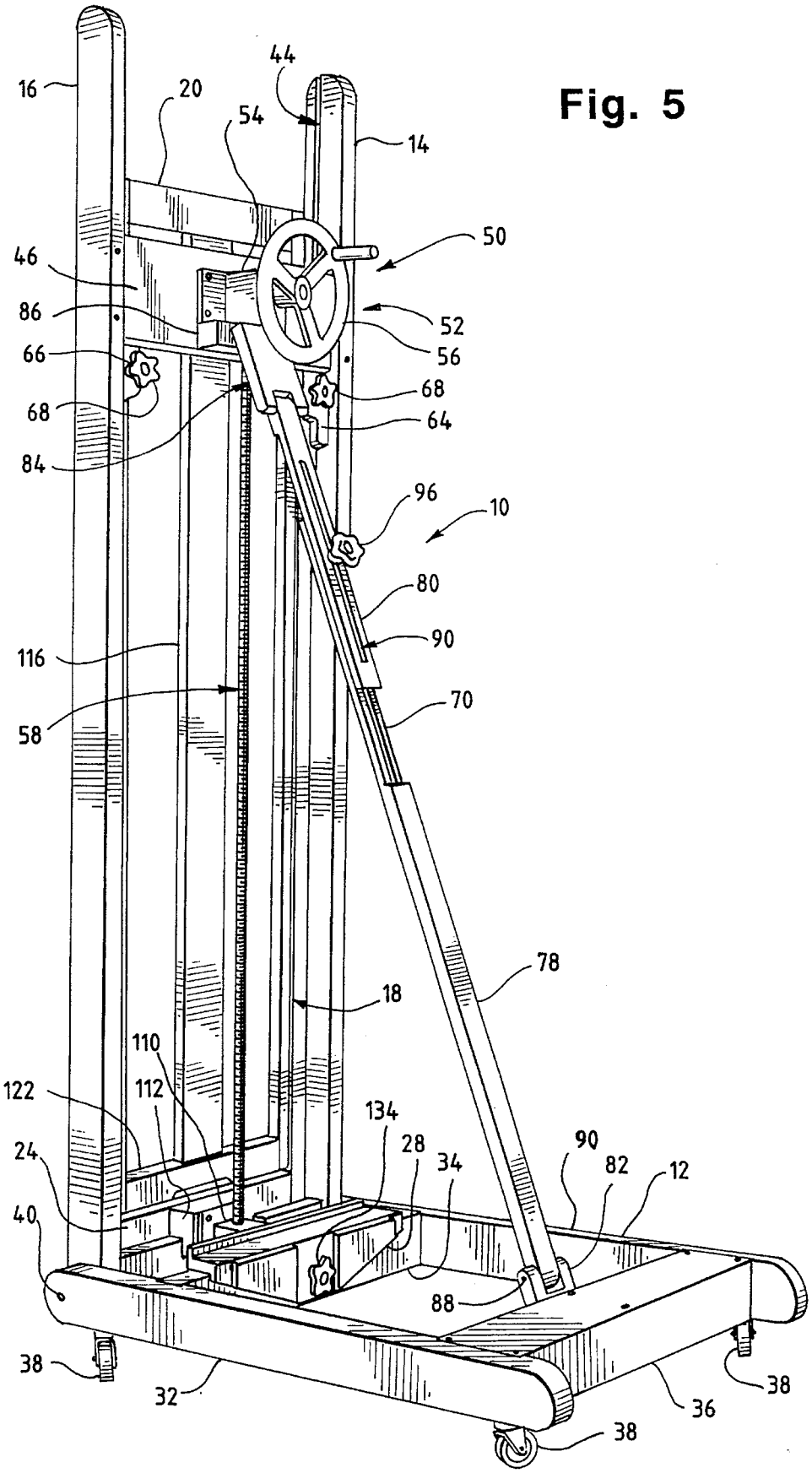
FIG. 5 is a rear perspective view of the easel illustrating the canvas lifting assembly and the telescoping angle support.

The carriage 12 illustrated in FIGS. 2 and 5 is constructed of a left horizontal carriage member 30, a right horizontal carriage member 32, a cross tie 34 and a counter weight housing 36, which are fastened together by screws, bolts or the like. To balance the weight of the canvas 22 (not illustrated in FIGS. 2 or 5) when mounted to the easel 10, the counter weight housing 36 preferably contains a predetermined amount of counter weight material (not illustrated), such as lead. To provide mobility to the easel 10, casters 38 may be mounted to the carriage 12, preferably on the horizontal carriage members 30 and 32.

The housing masts 14 and 16 are pivotally mounted to the corresponding horizontal carriage members 30 and 32 preferably by carriage bolts 40 and lock nuts (not illustrated). As FIG. 2 illustrates, the housing masts 14 and 16 and the horizontal carriage members 30 and 32 each have axially aligned bolt holes 42 through which the carriage bolts 40 (not illustrated) are inserted.

The housing masts 14 and 16 are each provided with a housing mortise 44 which extends along the longitudinal length of the housing masts 14 and 16 as FIGS. 2 and 5 illustrate. To maintain the housing masts 14 and 16 substantially parallel to each other, a top brace 46 is provided to join the upper ends of the housing masts 14 and 16 together and a bottom brace 48 is provided to join the lower ends of the housing masts 14 and 16. The top brace 46 preferably is mounted a predetermined distance off-center to prevent blockage of the housing mortise 44.

To raise and lower the outer frame 18 which is discussed more fully below, a canvas lifting assembly 50 is mounted between the top brace 46 and the bottom brace 48. As FIG. 5 illustrates, the canvas lifting assembly 50 has an upper portion 52 mounted to the top brace 46 which is encased by a cover 54 with a manually rotated wheel 56 extending therefrom.

Figure 7:
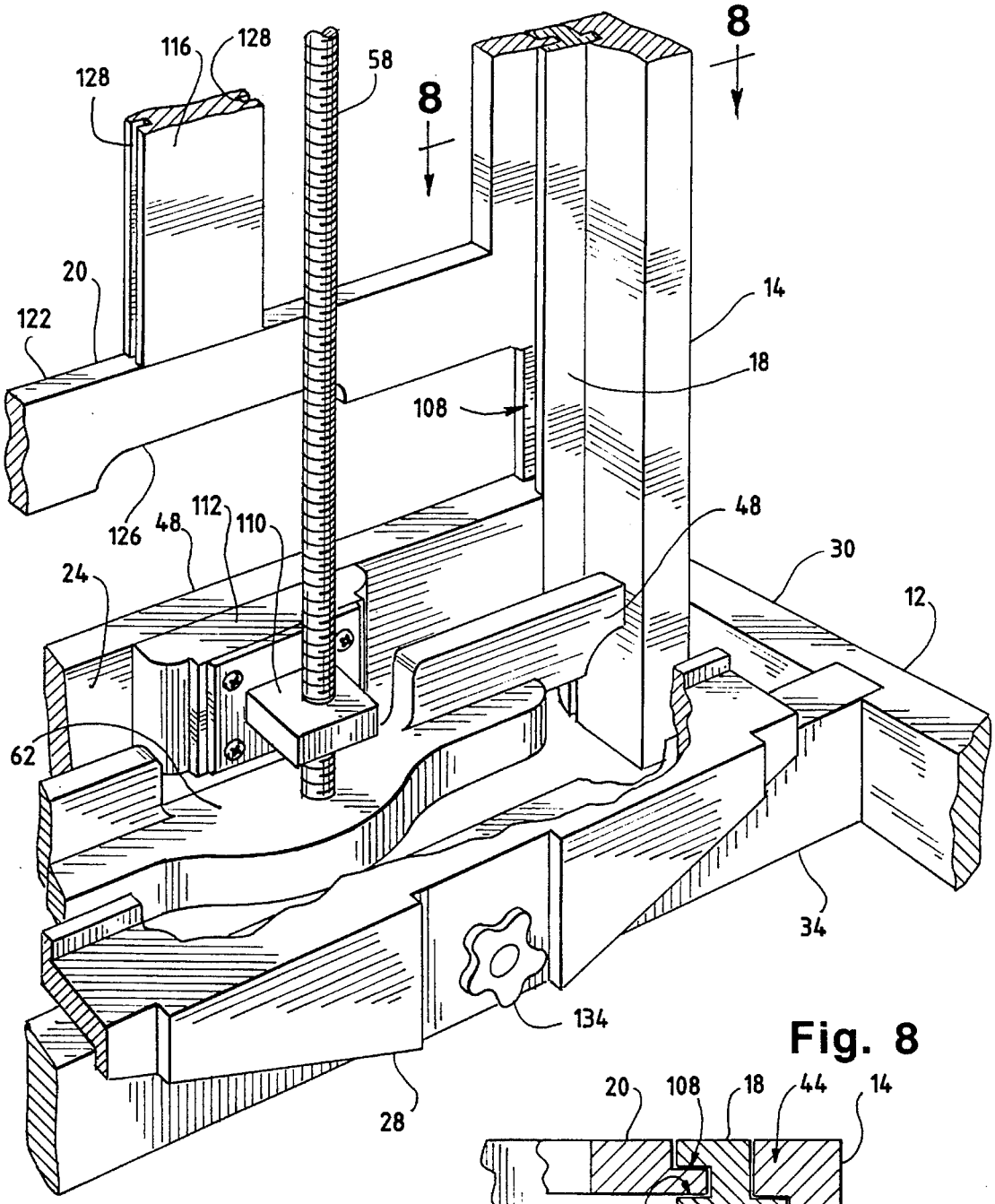
FIG. 7 is an enlarged view, in partial section, of the rear of a housing mast, outer frame and inner frame illustrating a lower portion of the canvas lifting assembly.

A rotatable shaft 58 extends parallel to the housing masts 14 and 16 and is preferably formed as a worm gear having three turns per 2.54 centimeters (1 inch). As FIG. 7 illustrates, the shaft 58 extends downward and seats with a shaft support 62 mounted to the bottom brace 48.

To drive the shaft 58 by cranking the wheel 56, the wheel 56 preferably is operatively connected to the shaft 58 by a right-angle bevel gear assembly 60 as FIG. 2 illustrates. While the wheel 56 is manually rotated to transfer rotary action to the shaft 58, one skilled in the art would recognize that the wheel 56 as shown in FIG. 2 could also be motorized.

To lock the inner frame 20 at a particular elevation as described more fully below, a left lock 64 and right lock 66 are mounted to the housing masts 14 and 16 respectively as illustrated in FIG. 5. The left and right locks 64 and 66 preferably have threaded inserts (not illustrated) which provide a compression force to the inner frame 20. The locks 64 and 66 are engaged or disengaged by turning a pair of star knobs 68 attached thereto.

Figure 6:
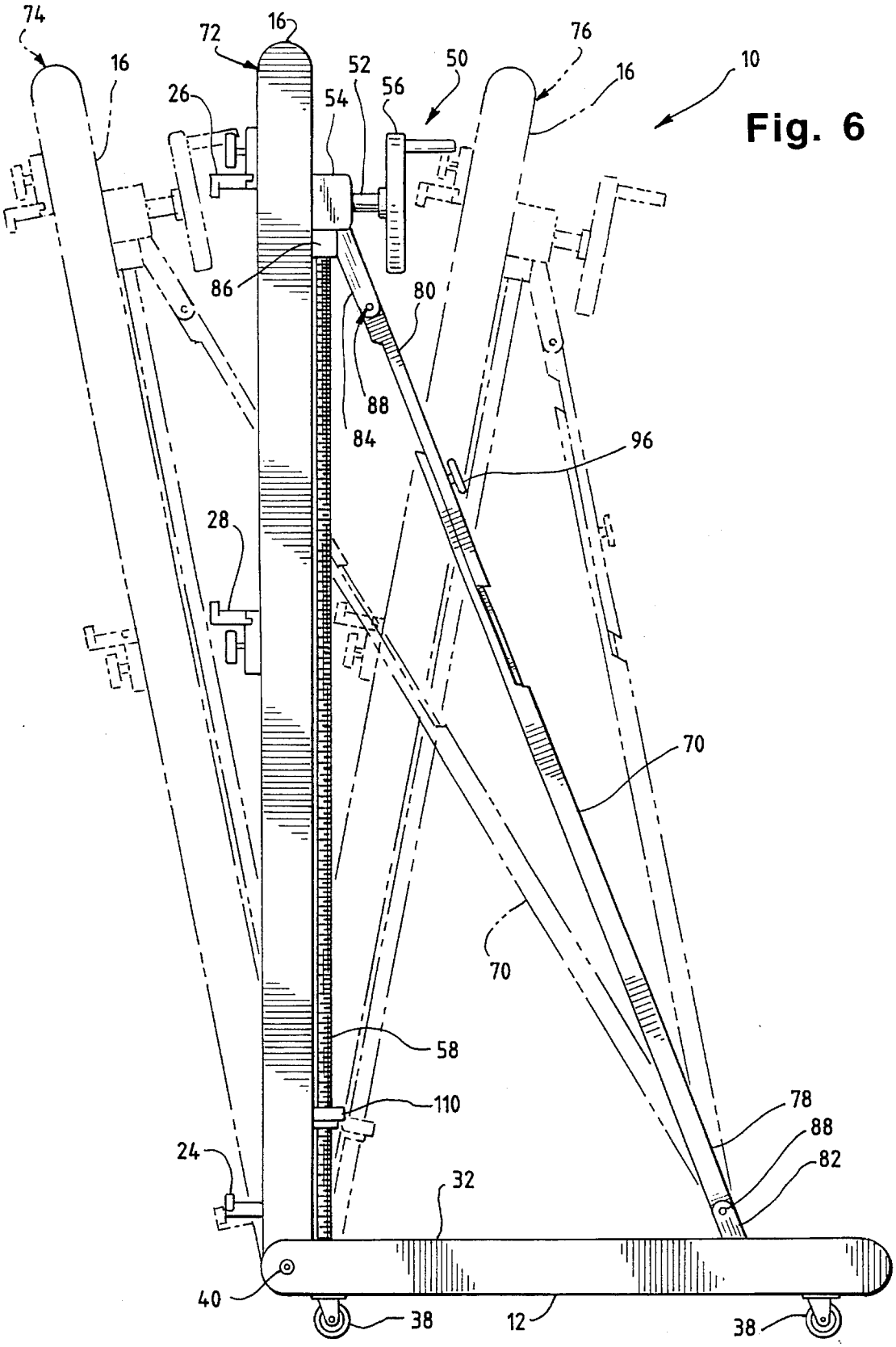
FIG. 6 is a side elevational view of the easel showing the housing masts disposed in a generally vertical position, with possible forward oriented and backward oriented positions of the housing masts illustrated in phantom outline.

As FIG. 6 illustrates, a telescoping angle support 70 is provided to vary the angular tilt of the housing masts 14 and 16. Typically, the housing masts 14 and 16 are oriented at or near a generally vertical position 72 perpendicular to the carriage 12. To circumvent glare or light refraction on the canvas 22 (not illustrated in FIG. 6), the housing masts 14 and 16 of the easel 10 may selectively be tilted to an upright position 74 forward of the generally vertical position 72. To place a very large canvas in position on the easel 10, the housing masts 14 and 16 may be oriented at an upright position 76 backward of the generally vertical position 72.

The angle support 70 includes a bottom support 78 and a top support 80 as FIG. 5 illustrates. The bottom support 78 preferably attaches to a bottom hinge 82 mounted to the counter weight housing 36. The top support 80 preferably attaches to a top hinge 84 which is mounted to a hinge pad 86 on the top brace 46. The hinge pad 86 has an aperture (not illustrated) through which the shaft 58 passes. The hinges 82 and 84 may be mounted in place by screws or other appropriate fasteners.

To permit attachment of the bottom and top supports 78 and 80 to their respective hinges 82 and 84, the bottom and top supports 78 and 80 as well as the bottom and top hinges 82 and 84 are each provided with a respective pivot hole 88 as FIG. 2 illustrates. To hold the supports 78 and 80 in place and allow pivoting engagement with the hinges 82 and 84, a brass pivot pin (not illustrated) is inserted through the pivot holes 88 when axially aligned.

To mate the bottom support 78 with the top support 80 of the telescoping angle support 70, the supports 78 and 80 are notched. To adjust the orientation of the housing masts 14 and 16 by adjusting the overall length of the angle support 70, the top support 80 is provided with a longitudinal channel 90 and the bottom support 78 is provided with a threaded hole 92. The channel 90 extends through the notched portion of the top support 80 and is aligned with the threaded hole 92.

To provide a locking effect to the bottom and top supports 78 and 80, a threaded insert 94 is inserted through the channel 90 and screwed into the threaded hole 92. A star knob 96 or other appropriate fixture is connected to the threaded insert 94 to provide a compression force which operates to lock and unlock the supports 78 and 80.

To ensure longitudinal alignment of the notched portions of the bottom support 78 and the top support 80, a longitudinal groove (not illustrated) may be provided on the notched portion of one support and a longitudinal tongue (not illustrated) may be provided on the notched portion of the other support. The tongue and groove (not illustrated) are adapted to seat one with the other and to permit the notched portions of the bottom support 78 and the top support 80 to slide longitudinally with respect to each other.

The outer frame 18 includes a left upright 98, a right upright 100 parallel to the left upright 98, a top cross tie 102 and a bottom cross tie 104 as FIG. 2 illustrates. The bottom canvas support 24 mounts horizontally to the bottom cross tie 104 and to the uprights 98 and 100 preferably by a dado arrangement or by other suitable fastening methods well known in the art.

To ensure that the inner frame 20 slides freely between the uprights 98 and 100 without interference when extensibly engaged, the top cross tie 102 mounts to the back face of the left and right uprights 98 and 100. The bottom cross tie 104 mounts flush with the front face of the left and right uprights 98 and 100.

Figure 8:
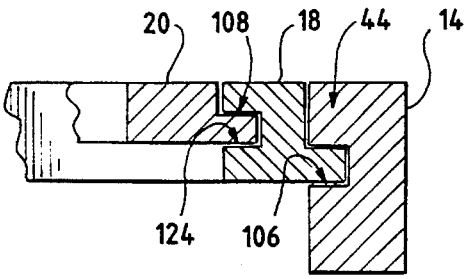
FIG. 8 is an enlarged, sectional view of the mortise and tenon joints between one of the housing masts, the outer frame and the inner frame taken along the line 8—8 in the direction indicated generally in FIG. 7.

To guide the outer frame 18 with respect to the housing masts 14 and 16 during extension and retraction, the uprights 98 and 100 each are provided with an outside tenon 106 extending longitudinally along the length of the uprights 98 and 100. The outside tenons 106 are dimensioned such that they readily seat as FIG. 8 illustrates and slide within the housing mortises 44 of the housing masts 14 and 16 without binding.

As FIG. 2 illustrates, each of the uprights 98 and 100 also are provided with an inner mortise 108 for slidable engagement of the inner frame 20 with the outer frame 18. The inner mortises 108 extend longitudinally along the length of the uprights 98 and 100 on the face opposite the outside tenons 106 as illustrated more clearly in FIGS. 7 and 8.

To lift the outer frame 18 by operation of the canvas lifting assembly 50, a lifting collar 110 on a lifting pad 112, as illustrated in FIG. 7, is mounted to the bottom cross tie 104 by screws, bolts or the like. To translate the rotational action of the threaded shaft 58 into a linear lifting or lowering force acting on the outer frame 18, the lifting collar 110 is threaded to operatively engage the shaft 58.

As FIG. 2 illustrates, the inner frame 20 includes a left upright 114, a center upright 116, a right upright 118 parallel to the left and center uprights 114 and 116, a top cross tie 120 and a bottom cross tie 122.

To guide the inner frame 20 with respect to the left and right uprights 98 and 100 of the outer frame 18 during extension and retraction, the left and right uprights 114 and 118 of the inner frame 20 each are provided with an outside tenon 124 extending longitudinally along the length of the uprights 114 and 118. The outside tenons 124 are dimensioned such that they readily seat as FIG. 8 illustrates and slide within the inner mortises 108 of the outer frame 18 without binding.

To facilitate lifting of the inner frame 20 by hand when the outer frame 18 has been extensibly engaged with the housing masts 14 and 16 and the inner frame 20 has been extensibly engaged with the outer frame 18, the bottom cross tie 122 is provided with a notched portion 126 as FIG. 1 illustrates.

The inner frame 20 also includes the top canvas support 26 mounted to the center upright 116. The top canvas support 26 is slidable along the center upright 116 in order to accommodate different size workpieces 22 on the easel 10.

To guide the top canvas support 26 as it slides along the uprights 114, 116 and 118, the top canvas support 26 is notched on the back face a predetermined depth to seat with the uprights 114, 116 and 118. To maintain the top canvas support 26 in contact with the inner frame 20 as it slides along the center upright 116, the center upright 116 is provided with a pair of longitudinal grooves 128 on opposite side faces as FIG. 7 illustrates. Metal plates (not illustrated) or other suitable equivalents which are capable of sliding upon insertion into the grooves 128 are fastened to the back of the top canvas support 26 by screws or other suitable fasteners.

To lock the top canvas support 26 at a selected position along the center upright 116, a threaded insert (not illustrated) attached to a star knob 130 extends through the top canvas support 26 and contacts the center upright 116 as FIG. 2 illustrates. Turning the star knob 130 provides a compression force between the top canvas support 26 and the center upright 116 which in combination with the metal plates (not illustrated) locks the top canvas support 26 in position.

The auxiliary canvas support 28 also may be mounted to the inner frame 20 to mount a workpiece solely to the inner frame 20. The auxiliary canvas support 28 is constructed and notched on the back face similar to the top canvas support 26 in order to seat against the uprights 114, 116 and 118.

To mount the auxiliary canvas support to the inner frame 20, a female threaded insert 132 is flush mounted into the center upright 116. Preferably the threaded insert 132 is brass or other hardened material. The auxiliary canvas support 28 is secured to the threaded insert 132 by a center lock 134 which screws into the threaded insert 132.

To accommodate different size canvasses 22, one or more additional threaded inserts 132' may be mounted on the center upright 116 to provide alternate locations for the auxiliary canvas support 28. One skilled in the art could also construct the auxiliary canvas support 28 identical to the top canvas support 26 so that it is adjustable for more flexibility in operation.

Figure 3:
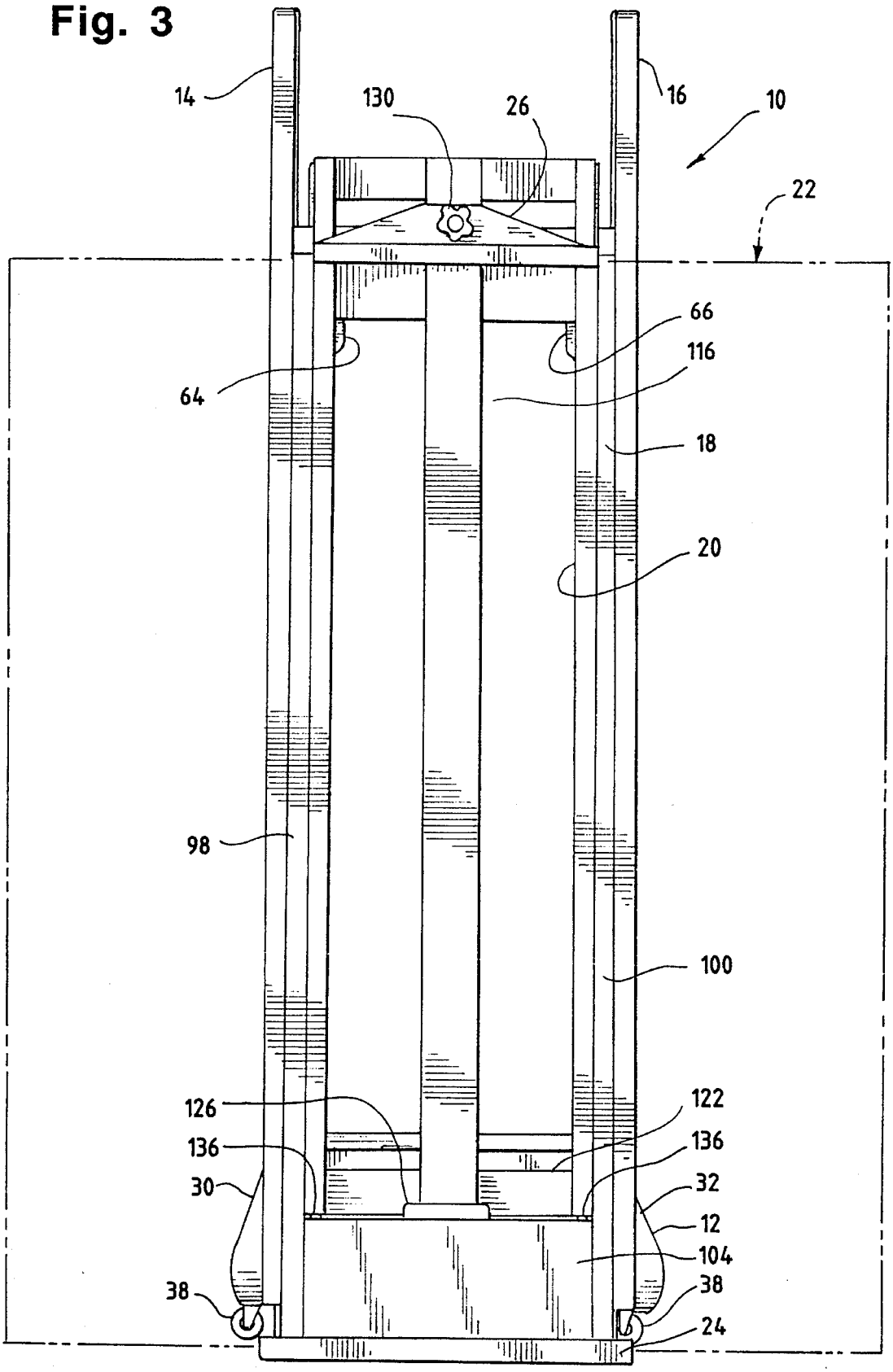
FIG. 3 a front elevational view of the easel illustrating the inner and outer frames fully retracted with respect to the housing masts.

To store the auxiliary canvas support 28 when not in use, the cross tie 34 of the carriage 12 can be constructed to seat the auxiliary canvas support 28 when turned upside down as FIG. 5 illustrates. As FIG. 3 illustrates, it also may be desirable to provide the bottom cross tie 122 of the inner frame 20 with rubber bumpers 136 to cushion the impact when the inner frame 20 seats against the outer frame 18.

In operation, the canvas 22 which may be of different sizes is secured to the easel. As FIG. 3 illustrates, the canvas 22 may be placed on the bottom canvas support 24 with the top canvas support 26 slid downwardly along the center upright 116 until contacting the canvas 22. To ensure that the canvas 22 remains seated on the easel 10, the top canvas support 26 preferably is locked in position by tightening the star knob 130. While FIG. 3 illustrates a large sized canvas 22 positioned on the easel 10, smaller sized canvasses 22 may be placed on the bottom canvas support 24 since the top canvas support 26 is slidable and has a range of positions essentially extending from one end of the inner frame 20 to the other.

As FIG. 1 illustrates, even larger canvasses 22 may be mounted on the bottom canvas support 24 by extending the inner frame 20 a selected distance independent of the outer frame 18. FIG. 1 illustrates the inner frame 20 and the top canvas support 26 near their fullest extension point.

To facilitate mounting of a very large canvas 22 on the easel 10, the inner frame 20 may be locked in position with respect to the housing masts 14 and 16 by the left and right locks 64 and 66. The outer frame 18 may still be moved downwardly by the canvas lifting assembly 50 when the inner frame 20 is locked in place.

The canvas 22 seated on the bottom canvas support 24 may be secured into position either by raising the outer frame 18 with the canvas lifting assembly 50 or by lowering the top canvas support 26. Locking the inner frame 20 into position is not required, however, since the inner frame 20 may be raised by hand and then lowered onto the canvas 22.

For smaller canvasses 22, it may be desirable to mount the canvas 22 solely to the inner frame 20 independent of the outer frame 18 as FIG. 4 illustrates. The auxiliary canvas support 28 is mounted to the center upright 116 by the center lock 134 and the canvas 22 is seated thereon. The top canvas support 26 is thereafter slid into position and if desired, locked in place with the star knob 130.

Once a particular size canvas 22 is mounted to the easel 10, the elevation of the canvas 22 may be adjusted within a broad elevation span. FIGS. 1 and 3 illustrate the canvas 22 seated on the bottom canvas support 24 substantially at floor level.

To reposition the canvass 22 at a selected elevation for painting a particular portion of the canvas 22, the canvas lifting assembly 50 may be operated to lift the outer frame 18 and the inner frame 20 in tandem. Cranking the wheel 56 illustrated in FIG. 2 rotates the shaft 58 and raises or lowers the lifting collar 110 and attached outer frame 18. As a result, the range of motion of a canvas 22 on the lower canvas support 24, extends from floor level to the upper ends of the housing masts 14 and 16. The lifting collar 110 eventually contacts the top brace 46 to limit the farthest extension point of the outer frame 18 and prevent overextension.

The canvas 22 also may be secured to the inner frame 20 by seating on the auxiliary canvas support 28 as FIG. 4 illustrates. The lowest elevation is near floor level when both the outer frame 18 and the inner frame 20 are fully retracted. The highest elevation extends past the upper ends of the housing masts 14 and 16 by fully extending the inner frame 18. To achieve full extension, the outer frame 18 may be used to raise or lower the inner frame 20 resting on the outer frame 18 by actuating the canvas lifting assembly 50. The inner frame 20 may also be raised or lowered by hand and locked into position with locks 64 and 66.

One skilled in the art will recognize that the highest elevation near the end of the inner frame 18 can be further heightened by fully extending both the inner frame 18 and outer frame 20. This may be accomplished by providing the outer frame 18 with locks (not illustrated) for locking the inner frame 20 with respect to the outer frame 18.

The orientation of the easel 10 is adjusted by the telescoping angle support 70. This is accomplished by loosening the threaded insert 94 of the bottom support by the star knob 96 to permit the threaded insert 94 to slide along the longitudinal channel 90 of the top support 80. To vary the length of the angle support 70 and change the orientation of the easel 10, the bottom support 78 is slid with respect to the top support 80 and relocked by tightening the star knob 96.

Modifications and variations of the present invention are possible in view of the above teachings. It therefore is to be understood that within the scope of the appended claims the invention may be practiced otherwise than as specifically described.

I claim:

1. An easel for supporting a workpiece at a range of elevations above floor level and for accommodating a range of workpiece sizes, said easel comprising:

a base including a carriage member having a lower surface adapted for disposition proximate to the floor level, a first housing mast and a second housing mast spaced apart from and parallel to said first housing mast, each of said housing masts oriented generally vertically and having a lower end connected to said carriage member;

an extensible outer frame slidably engaged with said housing masts, said outer frame including bottom support means for seating a bottom portion of said workpiece on said outer frame, first and second outer uprights each connected to said bottom support means, and communicating means in communication with said first and second housing masts for maintaining said outer frame in sliding engagement with said housing masts and for guiding said outer frame in a range of motion parallel to said housing masts, said outer frame adapted to be selectively positioned along said range of motion, said bottom support means being movable to a position wherein a lower surface of the bottom support means is aligned generally with the lower surface of the carriage member; and an extensible inner frame slidably engaged with said outer frame, said inner frame including first and second inner uprights having communicating means in communication with said first and second outer uprights of said outer frame for maintaining said inner frame in sliding engagement with said outer uprights of said outer frame and for guiding said inner frame in a range of motion parallel to said outer uprights of said outer frame and top support means on said inner frame for securing the workpiece seated on the bottom support means to the easel, said inner frame adapted to be selectively positioned independent of or in conjunction with said outer frame along said range of motion of said inner frame.

2. The easel as defined in claim 1 wherein said base includes lift means mounted thereto for selectively extending, retracting or securing said outer frame along said range of motion or said inner frame when said inner frame is supported by said outer frame.

3. The easel as defined in claim 2 wherein said outer frame includes a threaded lifting collar, and said lift means of said base include a threaded shaft rotatably mounted between said carriage and said housing masts and threadingly engaged with said lifting collar, a gear mounted to said housing masts and operatively engaged with said threaded shaft, and actuating means operatively engaged with said gear for selectively actuating said gear to induce rotation of said shaft and bias said lifting collar.

4. The easel as defined in claim 1 wherein said top support means is slidably mounted to said inner frame and is adapted to slide colinear with said range of motion of said inner frame.

5. The easel as defined in claim 4 wherein said housing masts include lock means in operable communication with said inner frame for providing a locking force to said inner frame and for selectively positioning said inner frame with respect to said housing masts independent of said outer frame.

6. The easel as defined in claim 1 wherein said inner frame includes auxiliary support means removably mounted to said inner frame for receiving the bottom portion of the workpiece to mount the workpiece on said inner frame independent of said outer frame.

7. The easel as defined in claim 6 wherein said top workpiece support means of said inner frame is adjustable in sliding engagement with said inner frame having a predetermined adjustment range parallel to said range of motion of said inner frame.

8. The easel as defined in claim 7 wherein said housing masts include lock means in operable communication with said inner frame for selectively positioning said inner frame with respect to said housing masts independent of said outer frame.

9. The easel as defined in claim 8 wherein said housing masts are pivotally mounted to said carriage and said carriage includes caster means for permitting movement of the easel and angle support means connected to said housing masts for selectively varying the orientation of said housing masts with respect to said carriage.

10. An easel for supporting a workpiece at a range of elevations and for accommodating a range of workpiece sizes, said easel comprising:

a base including a carriage member, a first housing mast and a second housing mast spaced apart from and parallel to said first housing mast, each of said housing masts oriented generally vertically and having a lower end connected to said carriage member;

an extensible outer frame slidably engaged with said housing masts, said outer frame including bottom support means, first and second outer uprights each connected to said bottom support means, and communicating means in communication with said first and second housing masts for maintaining said outer frame in sliding engagement with said housing masts and for guiding said outer frame in a range of motion parallel to said housing masts, said outer frame adapted to be selectively positioned along said range of motion; and an extensible inner frame slidably engaged with said outer frame, said inner frame including first and second inner uprights having communicating means in communication with said first and second outer uprights of said outer frame for maintaining said inner frame in sliding engagement with said outer uprights of said outer frame and for guiding said inner frame in a range of motion parallel to said outer uprights of said outer frame, auxiliary support means removably mounted to said inner frame for receiving a bottom portion of the workpiece and for mounting the workpiece on said inner frame independent of said outer frame and top support means for securing the workpiece seated on said auxiliary support means to the easel, said inner frame adapted to be selectively positioned independent of or in conjunction with said outer frame along said range of motion of said inner frame.

11. The easel as defined in claim 10 wherein said housing masts include lock means in operable communication with said inner frame for selectively positioning said inner frame with respect to said housing masts independent of said outer frame.

12. The easel as defined in claim 11 wherein said top support means of said inner frame is adjustable in sliding engagement with said inner frame having a predetermined adjustment range parallel to said range of motion of said inner frame for securing different size workpieces thereto.

13. The easel as defined in claim 12 wherein said base includes lift means mounted thereto for selectively extending, retracting or securing said outer frame along said range of motion or said inner frame when said inner frame is supported by said outer frame.

14. An easel for supporting a workpiece at a range of elevations and for accommodating a range of workpiece sizes, said easel comprising:

a base including a carriage member, a first housing mast and a second housing mast spaced apart from and parallel to said first housing mast, each of said housing masts oriented generally vertically and having a lower end connected to said carriage member;

an extensible outer frame slidably engaged with said housing masts, said outer frame including bottom support means for seating a bottom portion of said workpiece on said outer frame, first and second outer uprights each connected to said bottom support means, and communicating means in communication with said first and second housing masts for maintaining said outer frame in sliding engagement with said housing masts and for guiding said outer frame in a range of motion parallel to said housing masts, said outer frame adapted to be selectively positioned along said range of motion;

an extensible inner frame slidably engaged with said outer frame, said inner frame including first and second inner uprights having communicating means in communication with said first and second outer uprights of said outer frame for maintaining said inner frame in sliding engagement with said outer uprights of said outer frame and for guiding said inner frame in a range of motion parallel to said outer uprights of said outer frame and top support means on said inner frame for securing the workpiece seated on the bottom support means to the easel, said inner frame adapted to be selectively positioned independent of or in conjunction with said outer frame along said range of motion of said inner frame; and said housing masts including lock means in operable communication with said inner frame for providing a locking force to said inner frame and for selectively positioning said inner frame with respect to said housing masts independent of said outer frame.

15. An easel for supporting a workpiece at a range of elevations and for accommodating a range of workpiece sizes, said easel comprising:

a base including a carriage member, a first housing mast and a second housing mast spaced apart from and parallel to said first housing mast, each of said housing masts oriented generally vertically and having a lower end connected to said carriage member;

an extensible outer frame slidably engaged with said housing masts, said outer frame including bottom support means for seating a bottom portion of said workpiece on said outer frame, first and second outer uprights each connected to said bottom support means, and communicating means in communication with said first and second housing masts for maintaining said outer frame in sliding engagement with said housing masts and for guiding said outer frame in a range of motion parallel to said housing masts, said outer frame adapted to be selectively positioned along said range of motion;

an extensible inner frame slidably engaged with said outer frame, said inner frame including first and second inner uprights having communicating means in communication with said first and second outer uprights of said outer frame for maintaining said inner frame in sliding engagement with said outer uprights of said outer frame and for guiding said inner frame in a range of motion parallel to said outer uprights of said outer frame and top support means on said inner frame for securing the workpiece seated on the bottom support means to the easel, said inner frame adapted to be selectively positioned independent of or in conjunction with said outer frame along said range of motion of said inner frame; and said housing masts being pivotally mounted to said carriage and said carriage including angle support means connected to said housing masts for selectively varying the orientation of said housing masts with respect to said carriage.

* * * * *